US010577860B2

(12) United States Patent
Seuberling et al.

(10) Patent No.: US 10,577,860 B2
(45) Date of Patent: Mar. 3, 2020

(54) HIDDEN FASTENER WINDOW SCREEN INSTALLATION SYSTEM

(71) Applicants: David Seuberling, Cincinnati, OH (US); William F. Browning, Milford, OH (US)

(72) Inventors: David Seuberling, Cincinnati, OH (US); William F. Browning, Milford, OH (US)

(73) Assignee: Home Improvement Systems, Inc., Cincinnati, OH (US)

( * ) Notice: Subject to any disclaimer, the term of this patent is extended or adjusted under 35 U.S.C. 154(b) by 226 days.

(21) Appl. No.: 15/652,449

(22) Filed: Jul. 18, 2017

(65) Prior Publication Data

US 2019/0024451 A1 Jan. 24, 2019

(51) Int. Cl.
*E06B 9/52* (2006.01)

(52) U.S. Cl.
CPC ..... *E06B 9/52* (2013.01); *E06B 2009/527* (2013.01)

(58) Field of Classification Search
CPC ..... E06B 9/52; E06B 2009/527; E06B 9/521; E04B 9/30; E04B 9/303
USPC ..... 160/380, 395
See application file for complete search history.

(56) References Cited

U.S. PATENT DOCUMENTS 918,676 A 6/1909 Johnson
1,586,708 A 6/1926 Sandelin
2,568,139 A * 9/1951 Behnke ..... E06B 9/52 160/404
2,709,489 A * 5/1955 Keebler ..... E06B 9/52 160/381
3,058,518 A * 10/1962 Housman ..... E06B 3/285 160/380
3,220,469 A * 11/1965 Oehmig ..... E06B 9/52 160/380
3,469,695 A 9/1969 Greeninger
3,696,857 A 10/1972 Le Tarte
3,960,197 A * 6/1976 Daniels ..... A47G 1/0605 160/371
3,980,555 A 9/1976 Freissle
4,189,880 A 2/1980 Ballin
4,233,790 A * 11/1980 Meadows ..... E06B 3/285 160/395
4,234,035 A 11/1980 Babbs
4,333,284 A * 6/1982 Meadows ..... E06B 3/7001 160/179

(Continued)

*Primary Examiner* — Brent W Herring
(74) *Attorney, Agent, or Firm* — Indiano Law Group LLC

(57) ABSTRACT

A hidden fastener screen installation system is disclosed which includes a plurality of screen frame extrusions cooperating to form an opening across which a screen is positioned, wherein each screen frame extrusion defines at least one mounting surface configured to receive a plurality of mechanical fasteners to retain the screen frame extrusion to a portion of a building structure, and wherein at least one mounting rib extends outwardly from the mounting surface. The system further includes a trim mold defining a channel configured to closely receive and retain the mounting rib, wherein the screen is received in the channel and is retained by cooperation between the trim mold and the mounting rib, and wherein a portion of the trim mold is configured to extend over the fasteners such that the fasteners are hidden upon installation of the trim mold on the screen frame.

18 Claims, 3 Drawing Sheets

(56) References Cited

U.S. PATENT DOCUMENTS

| | | | | | |
|---|---|---|---|---|---|
| 4,410,027 | A * | 10/1983 | Lucous | E06B 3/285 | 160/380 |
| 4,658,522 | A | 4/1987 | Kramer | | |
| 4,690,192 | A * | 9/1987 | Stilling | E04H 15/04 | 160/395 |
| 4,899,797 | A * | 2/1990 | Green | E06B 9/52 | 160/380 |
| 5,086,604 | A * | 2/1992 | Orth | E06B 3/28 | 52/202 |
| 5,143,138 | A * | 9/1992 | Zwart | E06B 9/521 | 160/369 |
| 5,301,737 | A * | 4/1994 | Martin | E06B 9/52 | 160/380 |
| 5,586,400 | A * | 12/1996 | Moore, III | D05C 9/04 | 112/103 |
| 5,613,544 | A * | 3/1997 | Schaefer | E06B 9/52 | 160/371 |
| 5,666,773 | A | 9/1997 | Librande et al. | | |
| 5,904,200 | A | 5/1999 | Agen | | |
| 6,032,433 | A | 3/2000 | Hatziathanasiou | | |
| 6,378,267 | B1 * | 4/2002 | Bass | E06B 9/52 | 160/57 |
| 7,938,163 | B2 * | 5/2011 | Caruso | E06B 9/52 | 160/369 |
| 9,353,567 | B2 * | 5/2016 | Pardue | E06B 3/28 | |
| 9,487,999 | B2 * | 11/2016 | Seuberling | E06B 9/52 | |
| 9,518,423 | B2 * | 12/2016 | Seuberling | E06B 9/52 | |

* cited by examiner

HIDDEN FASTENER WINDOW SCREEN INSTALLATION SYSTEM

BACKGROUND

Most screens presently include a replaceable screen fabric. In the event the fabric is torn, stretched, or otherwise damaged, the fabric can be removed and replaced with another such fabric. A window screen installation system which permits the replacement of the screen is taught in U.S. Pat. No. 6,378,267 to Bass, the teachings of which are incorporated herein by reference. FIG. 1 is an illustration of a window screen installation system embodying the teachings of the prior art, specifically of the '276 patent to Bass. The window screen installation system 100 includes a screen frame 112 which is mounted to a window frame 104 through a plurality of fasteners 102. The fasteners 102 pass through the screen frame 112 and attach the screen frame 112 to an inner perimeter of a window frame 104. A mounting rib (not shown) extends perpendicularly outward from the screen frame 112. A trim mold 114 includes a channel opening on the bottom surface thereof structured to receive and retain the mounting rib therein. A screen 16 is retained between the trim mold 114 and the mounting rib of the screen frame 112 such that the screen is deformed over the mounting rib, and the mounting rib and the screen are both received within the trim mold channel.

As can be readily seen in FIG. 1, prior art screen replacement systems often include a plurality of visible fasteners 102. The use of mechanical fasteners, such as screws, provides for a stronger attachment between the window frame and the screen installation system than can be achieved with systems which utilize frictional fittings or adhesives. As would be understood to one of ordinary skill, events resulting in the tearing or damaging of the screen can result in the removal of the screen retaining frame absent the use of bolts, screws, or the like. Although the use of mechanical fasteners is desirable to retain a screen retention frame to a window frame, many architects find exposed fasteners to be unpleasant. In fact, many architects will not employ systems in which exposed fasteners are present. Therefore, further technological developments are desirable in this area.

SUMMARY

One embodiment of the present application includes a hidden fastener window screen installation system. Other embodiments include unique hidden fastener window screen installation apparatuses, systems, and methods. Further embodiments, inventions, forms, objects, features, advantages, aspects, and benefits of the present application are otherwise set forth or become apparent from the description and drawings included herein.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
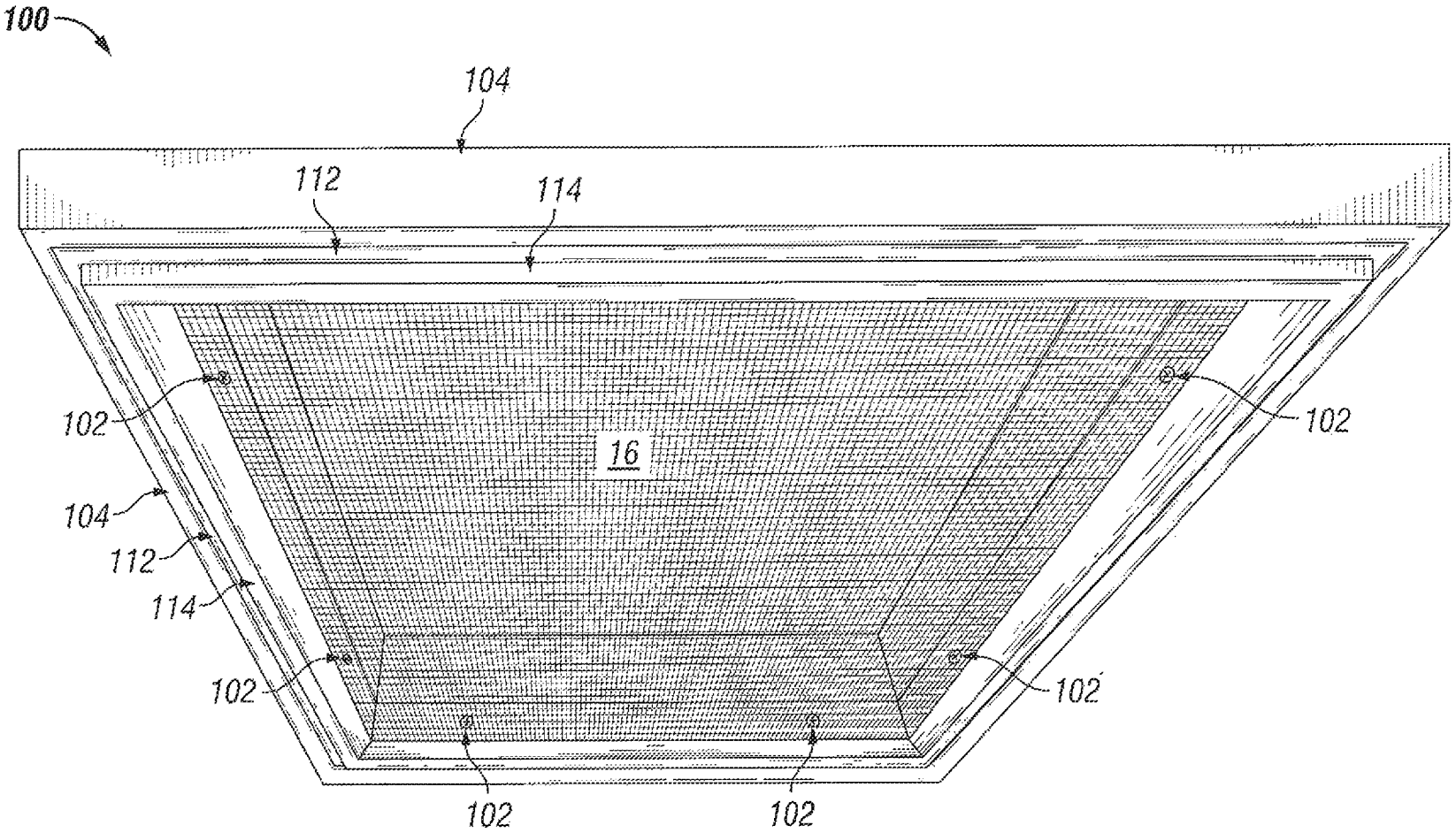
FIG. 1 (Prior Art)
FIG. 1 depicts a window screen installation system embodying the teachings of the prior art.

For purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 2:
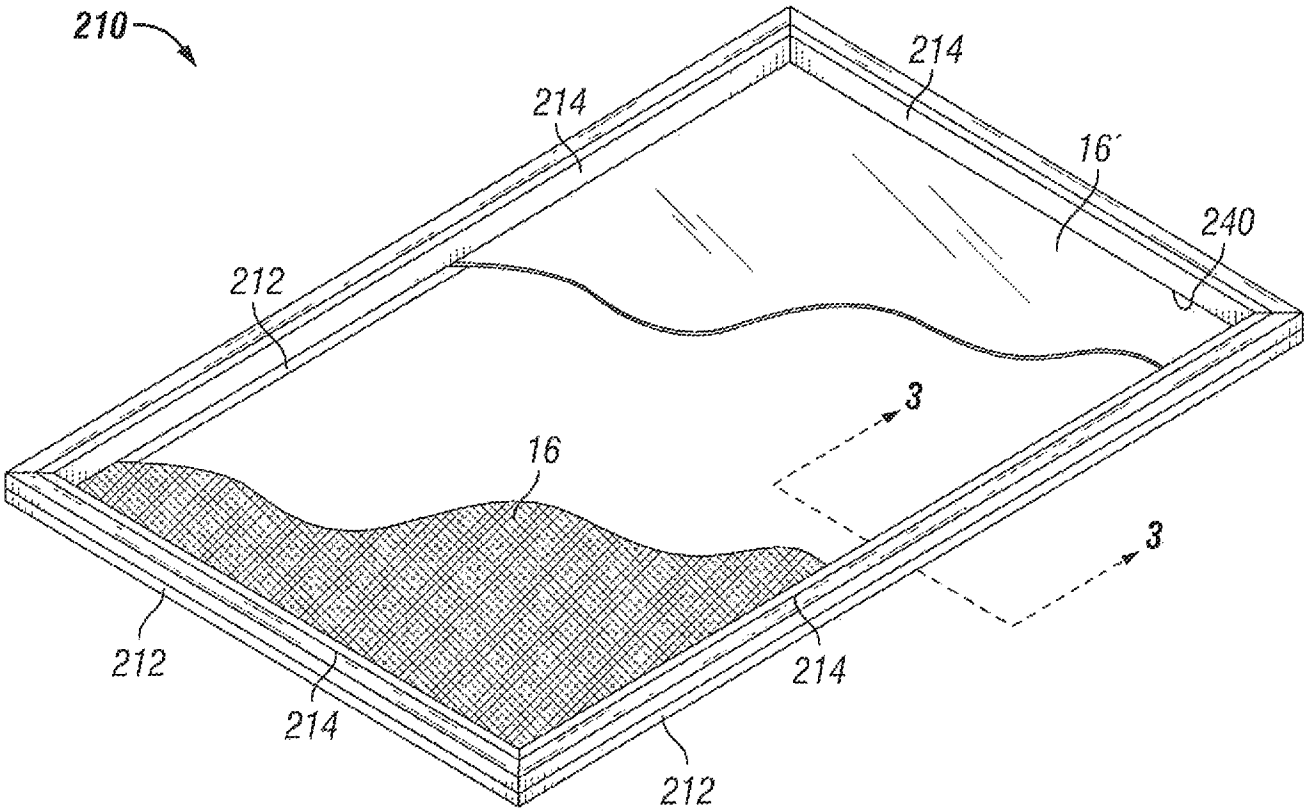
FIG. 2 is a perspective view of the hidden fastener window screen installation system constructed in accordance with several features of the present application.

FIG. 2 is a perspective view of a hidden fastener screen frame installation system 210 of the present application. The window screen installation system 210 includes a plurality of screen frames 212 which define an opening 240 across which is suspended a screen fabric 16 or other pliable sheet material. The cooperation between the screen frames 212 and trim molds 214 permit the releasable mounting of a screen fabric 16 in such a manner as to self-tighten the fabric during installation. While a hammer may be used to secure the trim molds 214 to the screen frames 212, the actual act of tightening of the screen or fabric 16 is accomplished without the use of any tools. Moreover, the screen frames 212 and trim molds 214 are designed to allow for the mounting of the screen or fabric 16 without damaging the same such that it may be removed and reused as required.

As will be discussed at depth hereinafter, the screen frame 212 is mounted near an opening of a structure via a plurality of mechanical fasteners. These mechanical fasteners extend through a mounting surface of the screen frame 212 and into a building structure providing a resilient attachment of the screen frame 212 to the structure. Although it is contemplated that the screen frames 212 can be mounted to various locations on the structure, some exemplary mounting locations include screen porch panels (as may be utilized to construct a screened in porch), window frames, door frames, or the like.

The trim mold 214 is configured such that it will cover, and thereby hide, the heads of any fasteners when the trim mold 214 is secured to the screen frame 212. Therefore, after installation of the trim mold 214 on the screen frame, the mechanical fasteners are no longer exposed. This results in an easy to install and remove, yet sturdy design, which is aesthetically pleasing.

A screen 16 may be installed for use in such applications as a storm door or a window screen, or for larger applications such as screened-in porches. However, in colder seasons, it may be preferable to replace the screen 16 with a transparent sheet material 16' such as vinyl. Accordingly, the present invention is designed to allow for the replacement of the screen 16 with the sheet material 16', and vice versa. For ease of description, use of the term "screen 16" is intended to include a conventional screen 16, a conventional transparent sheet material 16', or any other pliable sheet that may be used as a membrane in the screen frame 212 of the present invention.

Figure 3:
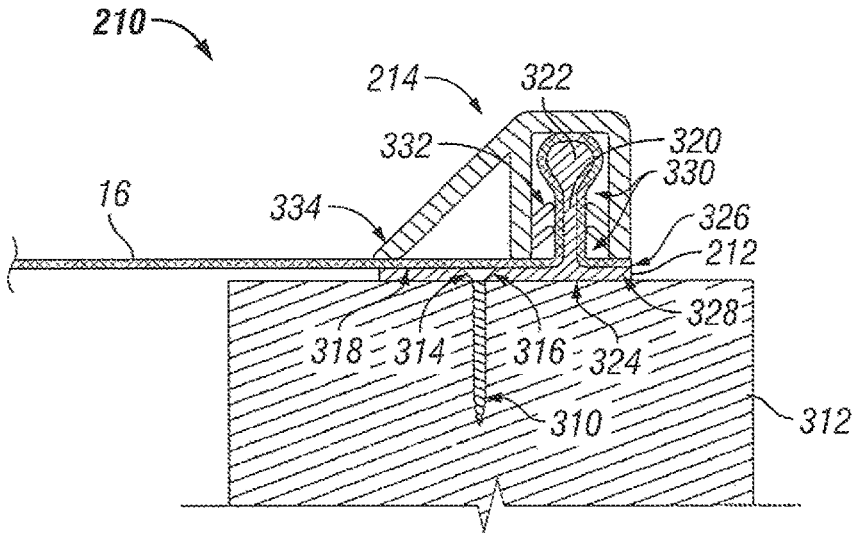
FIG. 3 is a cross sectional view of the hidden fastener window screen installation system taken at 3-3 of FIG. 2.

As is illustrated in FIG. 3, the screen 16 is disposed and held securely in place between the screen frame 212 and the trim mold 214. The screen frame 212 and trim mold 214 are each extruded members and the trim mold 214 is configured to receive and be retained upon the screen frame 212. The screen frame 212 includes a mounting surface 318 and a mounting rib 320 which extends outward from the mounting surface 318. The mounting surface 318 is illustrated as comprising a generally rectangular shape having an inner side 324 configured to abut against a surface of the structure 312. The mounting rib 320 extends outwardly in a substantially perpendicular manner relative an outer side 326 of the mounting surface 318. The mounting rib 320 and the mounting surface 318 are integrally extruded in a manner such that the mounting rib 320 extends along a length of the mounting surface 318. A bead 322 is defined at the terminal edge of the mounting rib 320 to serve as a locking mechanism. In one form, the screen frame is substantially T-shaped; however, various designs, including an L-shaped configuration are contemplated herein.

The mounting surface 318 is attached to the building structure 312 near an opening of the structure (not shown) such that the screen 16 can be suspended across the opening in the structure. The mounting surface 318 is configured to receive a plurality of fasteners 310. Fasteners 310 extend through the mounting surface 318 and into the structure 312 thereby retaining the screen frame 212 to the structure 312 in a sturdy, semi-permanent manner. The mounting surface 318 can include a plurality of apertures 316 which are designed to receive the plurality of fasteners 310. Each aperture 316 can include a taper configured to receive a head 314 of a fastener 310, such that the head of the fastener 310 is substantially flush with the outer side 326 of the mounting surface 318. Although the fastener 310 is depicted as a screw, it is contemplated that a variety of mechanical fasteners including, but not limited to, screws, bolts, or nails can be utilized to attach the mounting surface 318 to the structure 312 in a semi-permanent manner. The mounting rib bead 322 and the fasteners 310 do not penetrate the screen 16, thereby permitting the screen or fabric 16 to be removed and reused as desired.

The trim mold 214 is configured to closely receive the mounting rib 320 of the screen frame extrusion 212. To this extent, the trim mold 214 defines a channel 330 opening on a surface thereof and the channel 330 extends into the trim mold 214 a depth substantially equal to the height of the mounting rib 320. A plurality of retention barbs 332 disposed at an upward angle with respect to the mounting rib 320 are formed in the channel 330 to engage the mounting rib bead 322 in order to prevent inadvertent removal of the trim mold 214 from the mounting rib 320. In a preferred form, the height of the mounting rib 320 and bead 322 and the depth of the channel 330 are substantially equal.

The trim mold 214 includes a portion 334 which is designed to extend over and hide the fastener 310. In this manner, the fasteners 310 are not visible when the trim mold 214 is installed on the screen frame 212. This permits a "clean" installation free from visible mechanical fasteners, yet provides the structural integrity provided by the mechanical fastening of the screen frame 212 to the structure 312. In one form, the trim mold 214 includes a width substantially equal to a width of the mounting surface 318. In this form, when the trim mold 214 is installed over the mounting surface 318, the mounting surface 318 is substantially hidden by the trim mold 214.

Figure 4:
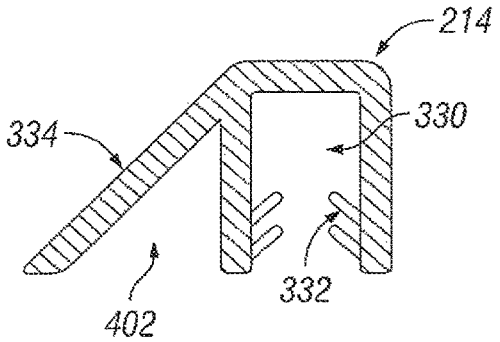
FIG. 4 depicts a cross sectional view of a trim mold which extends over the fasteners which retain a screen frame to a building structure.
Figure 5:
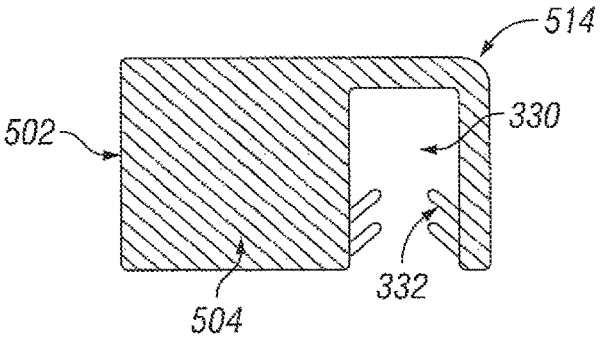
FIG. 5 depicts a cross sectional view of an alternate embodiment of a trim mold.
Figure 6:
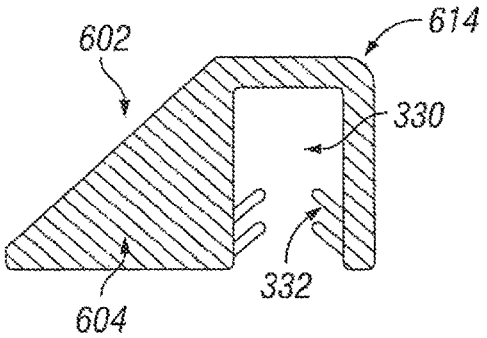
FIG. 6 depicts a cross sectional view of a further alternate embodiment of a trim mold.

FIGS. 4-6 depict alternative embodiments of the trim mold 214, 514, and 614. As is illustrated in FIG. 4, the trim mold 214 can include a tapered extension 334 which extends outwardly toward a first end (opposite end 328) of the mounting surface 318. This tapered extension 334 is designed to be placed over the head 314 of the fastener 310 thereby hiding the head 314 of the fastener 310. The tapered extension 334 can include a hollow cavity 402 which rests above the fastener 310. The use of such a hollow cavity 402 and a taper 334 reduces the amount of material utilized in the extrusion of the trim mold 214. Furthermore, the taper 334 can add an aesthetically pleasing aspect to the trim mold 214.

FIG. 5 discloses an alternative embodiment of a trim mold 514. This trim mold 514 is substantially rectangular in shape 502. The portion 504 of the trim mold 514 which covers the fastener 310 is depicted as being solid. FIG. 6 discloses yet a further alternative embodiment of a trim mold 614. Trim mold 614 includes a tapered extension 602, similar to tapered extension 334; however, the tapered extension 602 is solid 604 (does not contain hollow cavity 402). Although trim molds 214, 514 have been described in detail herein, it is contemplated that a wide variety of trim mold designs may be utilized which receive and are retained to the mounting rib 320 and cover the fasteners 310 such that upon the installation of the trim molds no fasteners 310 are exposed.

As was aforementioned, the screen frame 212 and the trim mold 214 are extruded and have a uniform cross-sectional profile. The screen frame 212 and the trim mold 214 can be extruded from various materials including, but not limited to, metals, polymers, or the like. In one specific form, the screen frame 212 is formed of extruded aluminum and the trim mold 214 is formed of an extruded polymer 214.

The installation process for the hidden window screen installation system 210 is described as follows. A plurality of screen frame extrusions 212 are cut and arranged to define the opening 240 across which a screen 16 or fabric is to be placed. A plurality of fasteners 310 are driven through a mounting surface 318 of the screen frame extrusions 212 and into the structure 312, thereby retaining the screen frame extrusions 212 to the structure 312.

The screen 16 is placed over the screen frame extrusion 212 at approximately the point to be attached. The trim mold 214 is then oriented upon the screen frame extrusion 212 such that the trim mold 214 will cover the fasteners 310 of the respective screen frame extrusion 212. Upon alignment of the trim mold 214 and the mounting rib 320 of the screen frame extrusion 212, the trim mold 214 is pressed toward the screen frame extrusion 212 such that the screen 16 is deformed over the mounting rib 320 and the mounting rib 320 and screen 16 are both received within the trim mold channel 330. The screen 16 is thus tightly received between the mounting rib 320 and the channel 330, with the retention barbs 332 assisting in the retention thereof. The fasteners 310 are now hidden from view by the trim mold 214.

To remove slack within the screen 16, it is preferably to attach trim molds 214 to opposing sides in an alternating fashion (e.g. attaching the top trim mold 214 over the top screen frame extrusion 212 and retaining the screen 16 therebetween, pulling the screen 16 tight over the bottom screen frame extrusion 212 and attaching the bottom trim mold 214 to retain the screen therebetween, then proceeding to the left and right sides). The amount of slack removed from each side of the screen 16 is substantially equal to a height of the mounting rib 320. Any excess screen 16 can be trimmed from an exterior perimeter of the trim mold 214. Although the screen frame extrusions 212 have been depicted as defining a substantially rectangular opening 240, it is contemplated that the screen frame extrusions 212 can be constructed to define a variety of opening 240 shapes and sizes including, but not limited to, octagons, squares, and archways.

In order to remove the screen 16, the trim mold 214 is simply pried away from the screen frame extrusion 212 with, for example, a flat head screwdriver. Thus, mounting and removal of the screen 16 typically do not damage the screen 16 as a result of not requiring the use of conventional fasteners such as screws.

From the foregoing description, it will be recognized by those skilled in the art that a hidden fastener window screen installation system offering advantages over the prior art has been provided. Specifically, the hidden fastener window screen installation system is designed for releasably mounting a screen or other pliable sheet material in such a manner as to self-tighten the fabric or material during installation. Although mechanical fasteners are used to mount the screen frame to the structure in a semi-permanent manner, the trim molds are configured to cover and effectively hide the fasteners from view. Tightening of the screen or fabric is accomplished without the use of any tools. Moreover, the screen frame is designed to allow for the mounting of the fabric or material without damaging the same such that it may be removed and reused as required.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A hidden fastener screen installation system, comprising:

a plurality of screen frame extrusions cooperating to form an opening across which a screen is positioned, wherein each screen frame extrusion defines at least one mounting surface and at least one mounting rib extending outwardly from said mounting surface, and wherein the mounting surface is configured to receive a plurality of mechanical fasteners'to retain the screen frame extrusion to a portion of a building structure; and a trim mold defining a channel configured to closely receive and retain the mounting rib, wherein the screen is received in the channel and is retained by cooperation between the trim mold and the mounting rib, wherein the screen is self-tightened as the trim mold is engaged with the screen frame extrusion, wherein the trim mold further includes a tapered extension extending outwardly toward a first end of the mounting surface, and wherein the tapered extension extends over the fasteners, thereby fully covering the fasteners such that the fasteners are completely hidden upon installation of the trim mold on the screen frame.

2. The hidden fastener screen installation system of claim 1, wherein the mounting rib defines a bead along a terminal edge of the mounting rib, and wherein the channel includes a plurality of retention barbs configured to engage the bead.

3. The hidden fastener screen installation system of claim 2, wherein the channel includes a depth substantially equal to a height of the mounting rib.

4. The hidden fastener screen installation system of claim 3, wherein the mounting rib extends in a direction that is substantially perpendicular to the mounting surface.

5. The hidden fastener screen installation system of claim 2, wherein the bead and the fasteners fail to penetrate the screen.

6. The hidden fastener screen installation system of claim 1, wherein the trim mold has a width approximately equal to a width of the mounting surface.

7. The hidden fastener screen installation system of claim 1, wherein the trim mold further includes a cavity in the tapered extension.

8. The hid den fastener screen installation system of claim 1, wherein the screen frame extrusion substantially comprises a T-shape.

9. A screen installation system, comprising:

a plurality of screen frame extrusions cooperating to form an opening across which a screen is retained, wherein each screen frame extrusion is attached to a building structure through, a plurality of fasteners extending through a mounting surface of the screen frame extrusion;

a mounting rib extending outwardly from the mounting surface of the screen frame extrusion, wherein the mounting rib is substantially perpendicular relative the mounting surface;

a bead located at a terminal edge of the mounting rib and defined by the mounting rib;

wherein the mounting surface, the mounting rib, and, the mounting rib bead are a unitary extrusion;

a trim mold extrusion having a channel configured to closely receive and retain the mounting rib, wherein the channel comprises a depth substantially equal to a height of the mounting rib, wherein the channel further defines a plurality, of retention barbs structured to engage the bead, wherein the screen is received within the channel and is retained between the trim mold and the mounting rib, and wherein the screen is self-tightened as the trim mold is engaged with the screen frame extrusion; and wherein the trim mold further includes a tapered extension extending outwardly toward a first end of the mounting surface, and wherein the tapered extension extends over the fasteners such that the fasteners are fully covered and concealed by the installation of'the trim mold on the screen frame.

10. The screen installation system of claim 9, wherein the mounting surface includes a plurality of apertures configured to receive the fasteners, and wherein the plurality of apertures are solely located in the mounting surface adjacent a first side of the mounting rib.

11. The screen installation system of claim 9, wherein the trim mold has a width approximately equal to a width of the mounting surface.

12. The screen installation system of claim 11, wherein the screen frame extrusion substantially comprises a T-shape.

13. The screen installation system of claim 9, wherein the trim mold further includes a cavity in the tapered extension.

14. The screen installation system of claim 9, wherein the screen is fabricated from a mesh-type screen selected to allow air flow therethrough.

15. A hidden fastener screen installation system, comprising:

a plurality of screen frame extrusions configured to define an opening across which a screen is to be positioned, wherein each screen frame extrusion includes a mounting surface and a mounting rib extending perpendicularly outward relative the mounting surface;

a plurality of apertures disposed in the mounting surface configured to receive a plurality of mechanical fasteners to retain the screen frame extrusion to a building structure;

a trim mold having a channel configured to closely receive and retain the mounting rib, wherein the screen, is retained between the mounting rib and the trim mold within the channel and is retained therein by cooperation between the mounting rib and the trim mold; and wherein the trim mold further includes a tapered extension extending outwardly toward a first end of the mounting surface, and wherein the tapered extension extends over, and fully covers the apertures thereby, concealing the fasteners when the mounting rib is engaged by the trim mold.

16. The hidden fastener screen installation system of claim 15, wherein the mounting rib defines a bead along a terminal edge of the mounting rib, wherein the channel includes a plurality of retention barbs configured to engage the mounting rib bead, and wherein the, channel includes a depth substantially equal to a height of the mounting rib.

17. The hidden fastener screen installation system of claim 16, wherein the trim mold has a width approximately equal to a width of the mounting surface.

18. The hidden fastener screen installation system of claim 17, wherein each of the plurality of screen frame extrusions substantially comprise a T-shape, and wherein the tapered extension further includes a cavity.

* * * * *